US011092010B2

(12) United States Patent
Mulvoy et al.

(10) Patent No.: US 11,092,010 B2
(45) Date of Patent: Aug. 17, 2021

(54) UNDERGROUND SUPPORT SYSTEM AND METHOD

(71) Applicant: DSI TUNNELING LLC, Louisville, KY (US)

(72) Inventors: John M. Mulvoy, Louisville, KY (US); Andrew J. King, Georgetown, IN (US)

(73) Assignee: DSI Tunneling LLC, Louisville, KY (US)

( * ) Notice: Subject to any disclaimer, the term of this patent is extended or adjusted under 35 U.S.C. 154(b) by 0 days.

(21) Appl. No.: 16/742,505

(22) Filed: Jan. 14, 2020

(65) Prior Publication Data

US 2020/0263542 A1 Aug. 20, 2020

Related U.S. Application Data

(60) Provisional application No. 62/823,286, filed on Mar. 25, 2019, provisional application No. 62/807,796, filed on Feb. 20, 2019.

(51) Int. Cl.
*E21D 11/08* (2006.01)
*E21D 5/12* (2006.01)
(Continued)

(52) U.S. Cl.
CPC ..... *E21D 11/107* (2013.01); *E21D 5/11* (2013.01); *E21D 5/12* (2013.01); *E21D 11/08* (2013.01); *E21D 11/385* (2013.01)

(58) Field of Classification Search
CPC ..... E21D 11/107; E21D 11/08; E21D 11/385; E21D 5/11; E21D 5/12
See application file for complete search history.

(56) References Cited

U.S. PATENT DOCUMENTS 290,133 A 12/1883 Stanley
597,590 A * 1/1898 Pratt ..... E01D 4/00 14/24
(Continued)

FOREIGN PATENT DOCUMENTS

AU 2002301468 B2 5/2004
CL 2014003482 A1 2/2015
(Continued)

OTHER PUBLICATIONS

Chile First Substantive Report dated May 6, 2020 from corresponding Chile Patent Application No. 2019-001057, 50 pages.
(Continued)

*Primary Examiner* — Benjamin F Fiorello
(74) *Attorney, Agent, or Firm* — Ohlandt, Greeley, Ruggiero & Perle, L.L.P.

(57) ABSTRACT

An underground support system having an underground reinforcement system that is at least partially encapsulated with concrete or a cement material. The underground reinforcement system includes a flexible wire mesh having a matrix of longitudinally and transversely extending metal wires. The matrix of longitudinally and transversely extending metal wires has at least one three-dimensional sheet, each sheet having at least one raised corrugation, positioned along the length of an underground space. The raised corrugation acts as a template depth girder for application of concrete or cement material at a defined depth such that the underground reinforcement system is at least partially encapsulated with the concrete or cement material.

29 Claims, 11 Drawing Sheets

(51) Int. Cl.

| | |
|---|---|
| ***E21D 11/10*** | (2006.01) |
| ***E21D 5/11*** | (2006.01) |
| ***E21D 11/38*** | (2006.01) |

(56) References Cited

U.S. PATENT DOCUMENTS

| | | | | |
|---|---|---|---|---|
| 1,359,675 | A | 11/1920 | Davidson | |
| 2,425,079 | A | 8/1947 | Billig | |
| 2,669,114 | A | 2/1954 | Mills | |
| 2,686,421 | A * | 8/1954 | Barron | E01D 4/00 52/87 |
| 3,113,402 | A | 12/1963 | Butler | |
| 4,003,178 | A | 1/1977 | Douthwaite | |
| 4,155,967 | A * | 5/1979 | South | E04B 1/169 264/32 |
| 4,416,928 | A | 11/1983 | Carl | |
| 5,380,123 | A | 1/1995 | Ryynanen | |
| 5,417,858 | A | 5/1995 | Derrick et al. | |
| 5,564,866 | A | 10/1996 | Snyder | |
| 6,820,387 | B2 | 11/2004 | Sacks et al. | |
| 8,104,233 | B2 | 1/2012 | Wilsey | |
| 8,122,662 | B2 | 2/2012 | Farrell, Jr. | |
| 8,365,489 | B1 | 2/2013 | Bond | |
| 8,627,612 | B2 | 1/2014 | Wilsey | |
| 9,187,901 | B2 | 11/2015 | Ogden et al. | |
| 9,579,710 | B2 | 2/2017 | Ogden et al. | |
| 2005/0031420 | A1* | 2/2005 | Domanski | E21D 11/006 405/288 |
| 2006/0137282 | A1 | 6/2006 | Anvick et al. | |
| 2008/0014398 | A1 | 1/2008 | Tueshaus et al. | |
| 2017/0355169 | A1 | 12/2017 | Sharon et al. | |
| 2018/0291736 | A1 | 10/2018 | Li et al. | |

FOREIGN PATENT DOCUMENTS

| | | | |
|---|---|---|---|
| CL | 2016000658 | U | 3/2016 |
| CL | 2019000711 | A1 | 3/2019 |
| CN | 105909268 | A | 8/2016 |
| CN | 109519201 | A | 3/2019 |
| DE | 1966497 | A1 | 4/1973 |
| DE | 2400895 | A1 | 4/1975 |
| DE | 2805629 | A1 | 8/1979 |
| DE | 4104298 | A1 | 8/1992 |
| JP | 11-101026 | A | 4/1999 |
| KR | 10-2017-0104678 | A | 9/2017 |

OTHER PUBLICATIONS

International Search Report dated Apr. 9, 2020 from corresponding International Patent Application No. PCT/US2020/013500, 3 pages.

Written Opinion dated Apr. 9, 2020 from corresponding International Patent Application No. PCT/US2020/013500, 9 pages.

International Preliminary Report on Patentability dated Nov. 17, 2020 from corresponding International Patent Application No. PCT/US2020/013500, 53 pages.

New Zealand Patent Examination Report 1 dated May 14, 2021 from corresponding New Zealand Patent Application No. 752645, 4 pages.

* cited by examiner

UNDERGROUND SUPPORT SYSTEM AND METHOD

CROSS-REFERENCED APPLICATIONS

This application claims priority to U.S. Provisional Application No. 62/823,286, filed on Mar. 25, 2019, and U.S. Patent Application Ser. No. 62/807,796, filed Feb. 20, 2019, both of which are incorporated herein in their entireties by reference thereto.

BACKGROUND

1. Field of the Disclosure

This disclosure relates to an underground support system, and a method of supporting an underground space. The underground support system is highly versatile and useful, for example, in a variety underground spaces (e.g., tunnels, shafts, caverns and stations), and also in underground spaces having a variety of different geometric shapes (e.g., cylindrical, elliptical, rectangular, triangular, and the like).

2. Discussion of the Background Art

Underground support systems, for example, tunneling roof and sidewall control, are important for the safety and wellbeing of workers and users of the finished underground operation. Surface control is critical to effective underground support systems such as tunneling roof and sidewall support systems. Surface control devices with adequate characteristics can help reduce or even eliminate progressive underground support system failures.

Underground support systems such as roof and sidewall supports are commonly used in underground tunneling, excavating, and mining operations to support and control the overhead and lateral rock and soil strata. In one conventional tunneling surface control system, hand tied rebar is used which requires massive amounts of manpower literally tying each and every corner of bar intersection with wire ties. The labor and time intensive rebar exerts a compressive force upon the mine roof and sidewall to prevent deterioration of the overhead and lateral rock and soil strata.

Such conventional underground support systems typically do not provide versatility for supporting a variety underground spaces (e.g., tunnels, shafts, caverns and stations), and also do not provide versatility for supporting underground spaces having a variety of different geometric shapes (e.g., cylindrical, elliptical, rectangular, triangular, and the like). Conventional underground support systems are typically limited to particular underground spaces having particular geometric shapes.

Due to this lack of space and geometric versatility and the labor intensity required for conventional underground support operations, it would be desirable to develop an underground support system that provides improved versatility for supporting a variety of underground spaces and underground spaces having a variety of different geometric shapes, and also improved installation efficiencies, improved quality control structural connections, and resultant job site safety.

The present disclosure provides many advantages, which shall become apparent as described below.

SUMMARY

This disclosure relates to an underground support system, and a method of supporting an underground space. The underground support system is highly versatile and useful, for example, in a variety underground spaces (e.g., tunnels, shafts, caverns and stations), and also in underground spaces having a variety of different geometric shapes (e.g., cylindrical, elliptical, rectangular, triangular, and the like).

This disclosure also relates to an underground support system comprising an underground reinforcement system. The underground reinforcement system comprises a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement system defines a geometric supporting framework.

This disclosure further relates, in part, to an underground support system comprising an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The initial underground reinforcement system comprises a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The initial underground reinforcement system defines a geometric supporting framework. The final underground reinforcement system comprises a plurality of structural supports positioned at spaced intervals along the length of an underground space, in which the structural supports comprise lattice girders. Each structural support defines the geometric supporting framework.

This disclosure yet further relates, in part, to an underground support system comprising an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The initial underground reinforcement system and the final underground reinforcement system comprise a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement system defines a geometric supporting framework.

This disclosure also relates to an underground support system comprising an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The initial underground reinforcement system and the final underground reinforcement system comprise a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement systems define a geometric supporting framework.

This disclosure further relates, in part, to a method of supporting an underground space. The method comprises positioning an underground support system against an underground substrate, and maintaining the underground support system in contact with the underground substrate. The underground support system comprises an underground reinforcement system. The underground reinforcement system comprises a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement system defines a geometric supporting framework.

This disclosure yet further relates, in part, to a method of supporting an underground space. The method comprises positioning an underground support system against an underground substrate, and maintaining the underground support system in contact with the underground substrate. The underground support system comprises: an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The initial underground reinforcement system comprises a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The initial underground reinforcement system defines a geometric supporting framework. The final underground reinforcement system comprises a plurality of structural supports positioned at spaced intervals along the length of the underground, in which the structural supports comprise lattice girders. Each structural support defines the geometric supporting framework.

This disclosure also relates to a method of supporting an underground space. the method comprises positioning an underground support system against an underground substrate, and maintaining the underground support system in contact with the underground substrate. The underground support system comprises: an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The at least one of the initial underground reinforcement system and the final underground reinforcement system comprises a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement system defines a geometric supporting framework.

This disclosure further relates, in part, to a method of supporting an underground space. The method comprises positioning an underground support system against an underground substrate, and maintaining the underground support system in contact with the underground substrate. The underground support system comprises: an initial underground reinforcement system, in which the initial underground reinforcement system is encapsulated with concrete or a cement material; a final underground reinforcement system, in which the final underground reinforcement system is encapsulated with concrete or a cement material; and a moisture barrier system, in which the moisture barrier system is positioned between the initial underground reinforcement system encapsulated with concrete or a cement material, and the final underground reinforcement system encapsulated with concrete or a cement material. The initial underground reinforcement system and the final underground reinforcement system comprise a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement systems define a geometric supporting framework.

This disclosure yet further relates, in part, to an underground reinforcement system comprising a flexible wire mesh comprising a matrix of longitudinally and transversely extending metal wires. The matrix of longitudinally and transversely extending metal wires comprises a plurality of three-dimensional sheets, each sheet having at least one raised corrugation, positioned along the length of an underground space. The raised corrugation acts as template depth girders for application of concrete or cement material at a defined depth such that the underground reinforcement system is encapsulated with the concrete or cement material. The underground reinforcement system defines a geometric supporting framework.

An advantage of this disclosure is the ability of the underground support system to provide improved versatility for supporting a variety underground spaces (e.g., tunnels, shafts, caverns and stations) having a variety of different geometric shapes (e.g., cylindrical, elliptical, rectangular, triangular, and the like), improved installation efficiencies, improved quality control structural connections, and resultant job site safety. The underground reinforcement system of this disclosure replaces conventional undergrounding surface control systems, such as labor and time intensive hand tied rebar. In contrast to labor and time intensive hand tied rebar, the underground reinforcement system of this disclosure can be prefabricated off site. This allows welding of mesh placement and overlapping or intersections instead of tied rebar, and provides repetitive and improved quality and durability during placement on site. The underground support system of this disclosure provides compression for holding in place the underground roof and sidewall material, and thereby prevents collapse of the underground space.

Further objects, features and advantages of the present disclosure will be understood by reference to the following drawings and detailed description.

DETAILED DESCRIPTION OF THE EMBODIMENTS

Figure 1:
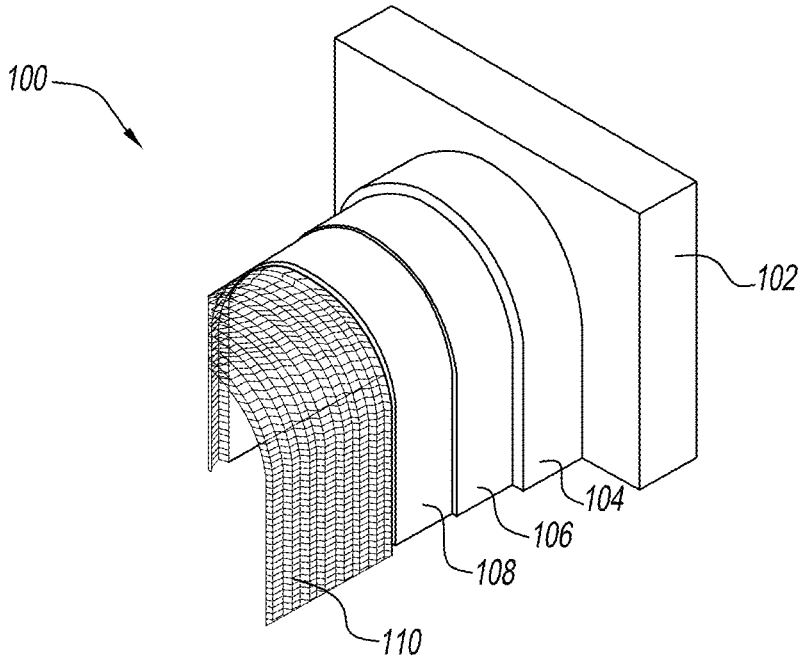
FIG. 1 shows a partially exploded view of a tunnel support system in accordance with an embodiment of this disclosure.

This disclosure provides a prefabricated reinforcement system for initial and final underground space, e.g., tunnels, shafts, linings, caverns, stations, and the like). In comparison with conventional tied rebar support systems, the underground reinforcement systems of this disclosure offer higher quality shop fabrication, reduced installation time (e.g., less manhours), lower costs, topside panel completion, increased safety including less manpower in harms way during installation, and significant erection safety.

In addition, the underground reinforcement systems of this disclosure offer higher versatility for supporting a variety underground spaces (e.g., tunnels, shafts, caverns and stations), an also higher versatility for supporting underground spaces having a variety of different geometric shapes (e.g., cylindrical, elliptical, rectangular, triangular, and the like). Conventional underground support systems are typically limited to particular underground spaces having particular geometric shapes.

Prefabricated flexible wire mesh is preferably used in the underground support system of this disclosure. The underground reinforcement system of this disclosure provides equivalent area of steel (As) in comparison to conventional rebar reinforcement systems. The underground reinforcement system of this disclosure significantly improves installation cycle times. The underground reinforcement system of this disclosure provides lower overall installation cost and improved safety in comparison with conventional labor and time intensive rebar systems.

Three-dimensional flexible mesh sheets are useful in the underground reinforcement system of this disclosure. The three-dimensional flexible mesh sheets have at least one raised corrugation. The raised corrugation acts as template depth girders for application of concrete or cement material at a defined depth such that the underground reinforcement system is encapsulated with the concrete or cement material. The mesh configuration and number of mesh sheets is limited only be application space and contractor capabilities.

The underground reinforcement system of this disclosure utilizes flat mats/sheets of wire/steel pressed/deformed into a three-dimensional axis structure thereby providing structural support for placement and use in underground excavations for initial or final support. The deformed mats/sheets provide raised corrugations for application of shotcrete depths as required. The mats/sheets can be further pressed/deformed/rolled to define or match the excavation section for easy installation and profile control. The lattice girder mesh allows for multiple installation of template depth girders with a single mat/sheet.

The lattice girder mesh system of this disclosure is designed to improve the quality and reduce the time required to install shotcrete template structures in underground excavations. Presently, underground excavations are initially supported by flat wire mesh panels bolted to the rock or earth with shotcrete sprayed to a defined depth for design conformance. Other methods include heavier bar tied systems similarly bolted to cavern, shaft or tunnel walls. Still other systems utilize lattice girders. The lattice girder mesh system of this disclosure is a three-dimensional steel structure bent/rolled to provide shotcrete template depth as well as profile control to an underground excavation. Lattice girder mesh combines each of these features into one individual system of deformed flat sheets to create the three-dimensional attributes with multiple girders per sheet. Once installed, the lattice girder mesh is a fairly rigid structure and after encapsulation in shotcrete, is a part of a structural element, e.g., the underground support system.

The underground reinforcement system of this disclosure can utilize lap joints with rebar for joining overlapping mesh sheets. Overlap of the deformed mesh is not needed where the use is for only shotcrete depth only. However, there will be applications that require application to provide some structural continuity across the deformed mats/sheets. This is analogous to reinforced lap bar splicing where the development length (overlap) provides continuity of the structural element, either a single bar or lattice girder.

The overall placement of overlapped mesh pieces in the underground reinforcement system of this disclosure is not critical. In an embodiment, the mat/sheets can be installed in either direction. For example, when the deformations/corrugations align longitudinally, the mesh mats/sheets will easily roll/bend to match the excavated ground line. The attachment is typically by a bolt of some type with a plate. In this arrangement, a supplemental lightweight bar system will be applied circumferentially for profile control. When the mesh mat/sheet is oriented 90 degrees differently, the deformations/corrugations require pre-formed bending for profile control.

The flexible wire mesh used in this disclosure can be prepared by conventional processes. For example, mesh mat/sheet deformation can be created by mechanical presses and/or the manual fabrication of individual bar elements attached together in a mat/sheet form. The spacing and height of the deformations/corrugations is a design element specific to the application for shotcrete depth and intended girder dimensions.

In an embodiment, the lattice girder mesh of this disclosure is a pre-assembled product for installation in underground spaces requiring easy and simple installation. Prefabricated mats/sheets meeting the project requirements are delivered and bolted into the excavation walls and crown/ceilings with the prescribed overlap. Bolts can vary from rock bolts to solid type bolts of various manufacture as per embedment and designed restraint.

In an embodiment, the lattice girder mesh used in this disclosure is a designed mat/sheet of varying component pieces from about ⅛ inch wire to bars of about 1 inch or so. The only limitation is the design load requirements or material handling limitations in the underground space. The wire/bar spacing is variable and dependent of the intended use.

The flexible wire mesh useful in this disclosure can be a plurality of sheets connected in an overlapping configuration. The flexible wire mesh can be configured from a plurality of metal wires welded together or woven together. The flexible wire mesh can be formed of a plurality of metal wires of a first gauge, a plurality of metal wires of a second gauge, or a combination thereof. The flexible wire mesh can be formed of a plurality of metal wires of a first cross-sectional shape, a plurality of metal wires of a second cross-sectional shape, or a combination thereof. The flexible wire mesh permits positioning or bending of the sheets along the length and geometry of the underground space. In an embodiment, the flexible wire mesh has two or more raised corrugations per sheet. The flexible wire mesh has ductile qualities that are important in the bending/pressing/deforming of the sheets/mats for the corrugations to develop.

The underground space supported by the underground support system of this disclosure can be any underground space capable of being supported, for example, a tunnel, shaft, cavern or station. The underground support system can be installed in an underground excavation that is vertically or horizontally oriented.

The geometric supporting framework formed from the underground support system of this disclosure can be any geometric supporting framework, for example, a vertically or horizontally oriented, three-dimensional geometric shape.

In an embodiment, rebar can be used for additional support, in particular, rebar interconnecting with the flexible wire mesh. One or more stabilizing members (e.g., bolts or hooks) can be connected to the flexible wire mesh. Also, one or more stabilizing members (e.g., tie rods) can be connected to overlapping sheets of flexible wire mesh.

In one embodiment, the lattice girder mesh of this disclosure is generally used as an initial support system as the installation speed is important. However, in the mining applications where initial and final support may not be differentiated from, the lattice girder mesh would be used as a final liner reinforcement as well. Similarly, in underground sewer, stormwater utility or other passage rehabilitation effort, the lattice girder mesh would be used as the final liner reinforcement. Once installed, the lattice girder mesh is a fairly rigid structure and after encapsulation in shotcrete, is a part of a structural element, e.g., the underground support system.

The cement can be introduced and retained in the installed underground support system of this disclosure (without dripping out) by conventional methods such as using shotcrete. Shotcrete is a class of sprayed concrete shot from a nozzle under pressure into the space created by the lattice girder mesh. As the shotcrete is another specific design element for strength and cure rate, it is designed to adhere and maintain profile by combinations of cement, water volume and other admixtures so as not to leave the intended placement area.

The underground support system of this disclosure can be used in tunnel intersection configurations. The lattice girder mesh of this disclosure is suitable for use at intersecting tunnels. Much as drywall is trimmed from window dormers in a home, lattice girder mesh is applied and trimmed to create the three-dimensional intersection of the two tubes. The overlaps are easily trimmed back by torch or other mechanical shear device.

Additionally, most underground caverns, tunnels, shafts and stations require a water proofing membrane to eliminate water intrusion or exit. Use of conventional tied bar reinforcement typically requires the installation of expensive and time consuming bolts to support the reinforcement bar mat while put into place. Use of the underground reinforcement systems of this disclosure in total eliminates the bolts which thereby eliminates the bolt penetration through the membrane. The cost of installation and subsequent repairs is very costly. The underground reinforcement systems of this disclosure solve this problem.

A partially exploded view of a tunnel support system of this disclosure is shown in FIG. 1. The tunnel support system 100 is positioned against a tunnel substrate 104, which is underground 102. The substrate can be, for example, rock, soil or an existing structure. The tunnel support system 100 includes a tunnel reinforcement system 108, which is overlayed or encapsulated with concrete or a cement material 106. The final tunnel reinforcement system 108 includes a flexible wire mesh 110 having raised corrugations positioned along the length of the tunnel. The flexible wire mesh 110 having raised corrugations defines a geometric supporting framework (e.g., arch).

Figure 2:
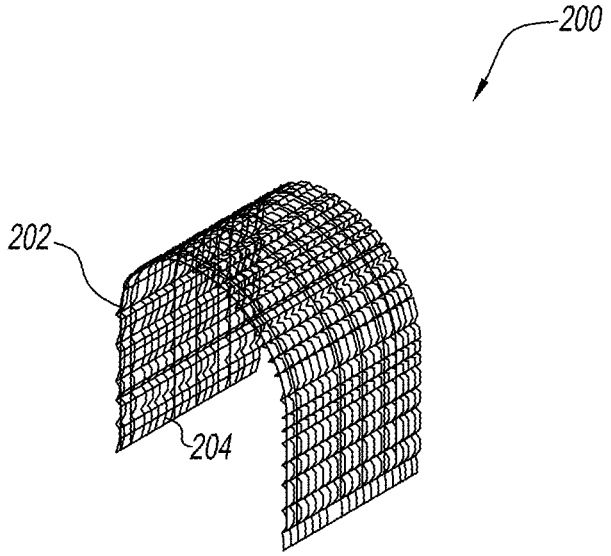
FIG. 2 shows a section of flexible wire mesh defining a geometric supporting framework in accordance with an embodiment of this disclosure.

In an embodiment, a section of flexible wire mesh 200 defining a geometric supporting framework is shown in FIG. 2. The flexible wire mesh 202 has raised corrugations 204 that act as template depth girders for application of concrete or cement material at a defined depth such that the underground reinforcement system is encapsulated with the concrete or cement material. The flexible wire mesh 202 having raised corrugations 204 defines a geometric supporting framework (e.g., arch).

Figure 3:
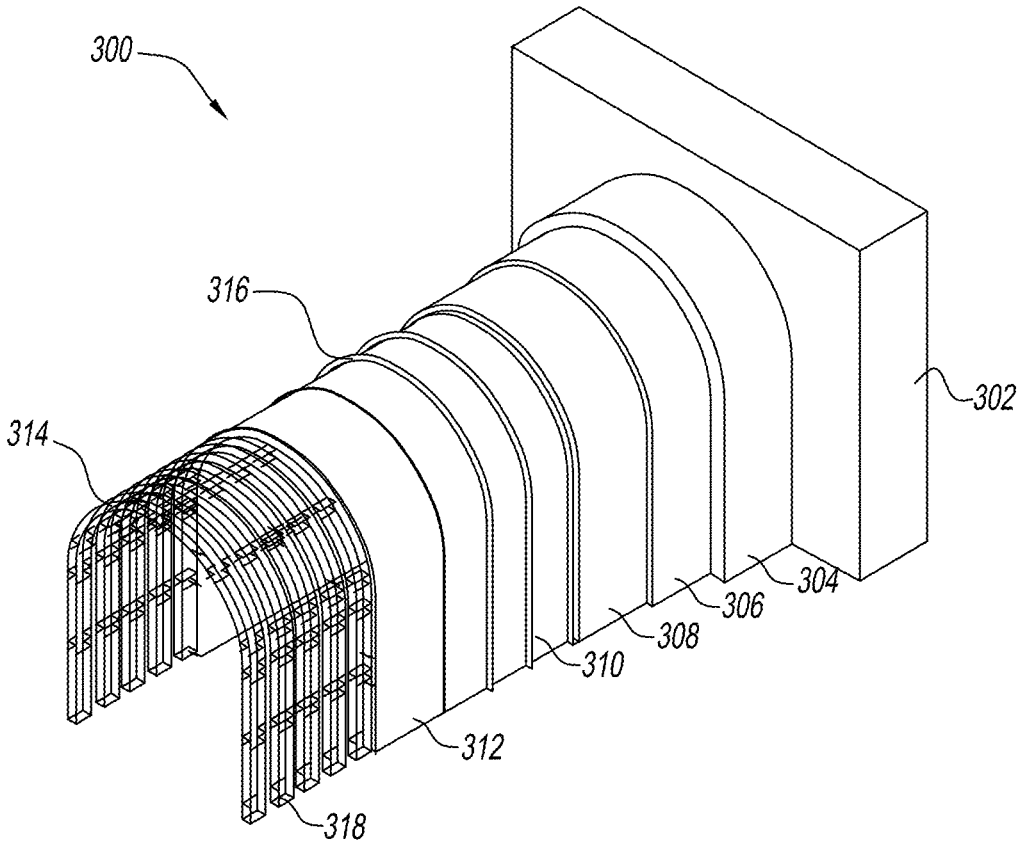
FIG. 3 shows a partially exploded view of a tunnel support system in accordance with an embodiment of this disclosure.

A partially exploded view of a tunnel support system of this disclosure is shown in FIG. 3. The tunnel support system 300 is positioned against a tunnel substrate 304, which is underground 302. The substrate can be, for example, rock, soil or an existing structure. The tunnel support system 300 includes an initial tunnel reinforcement system 308, which is overlayed or encapsulated with concrete or a cement material 306. The tunnel support system 300 also includes a final tunnel reinforcement system 314, which is overlayed or encapsulated with concrete or a cement material 312. The tunnel support system 300 further includes a moisture barrier system 310. The moisture barrier system 310 is positioned between the initial tunnel reinforcement system 308 overlayed or encapsulated with concrete or a cement material 306, and the final tunnel reinforcement system 314 overlayed or encapsulated with concrete or a cement material 312. The initial tunnel reinforcement system 308 includes a flexible wire mesh having raised corrugations positioned along the length of the tunnel (not shown). The flexible wire mesh having raised corrugations defines a geometric supporting framework (e.g., arch). The final tunnel reinforcement system 314 includes a plurality of structural supports 316 and 318, respectively, positioned at spaced intervals along the length of the tunnel. Each structural support 316 and 318 defines a geometric supporting framework (e.g., arch).

The initial support structure 308 is typically a template lattice girder of some depth and spacing to allow the spray application of concrete or a cement material 306 which adheres to tunnel walls and ceilings. In the initial tunnel reinforcement system 308, the lattice girder mesh functions as a concrete depth gage and provides a minimal structural element of support to the initial shell. In the final tunnel reinforcement system 314, the lattice girders 318 function as a concrete depth gage and provide a more maximal structural element of support to the final shell. The tunnel reinforcement system of this disclosure is far more dense in terms of steel and design as part of the initial and/or final shell in comparison to a conventional rebar system.

Figure 4:
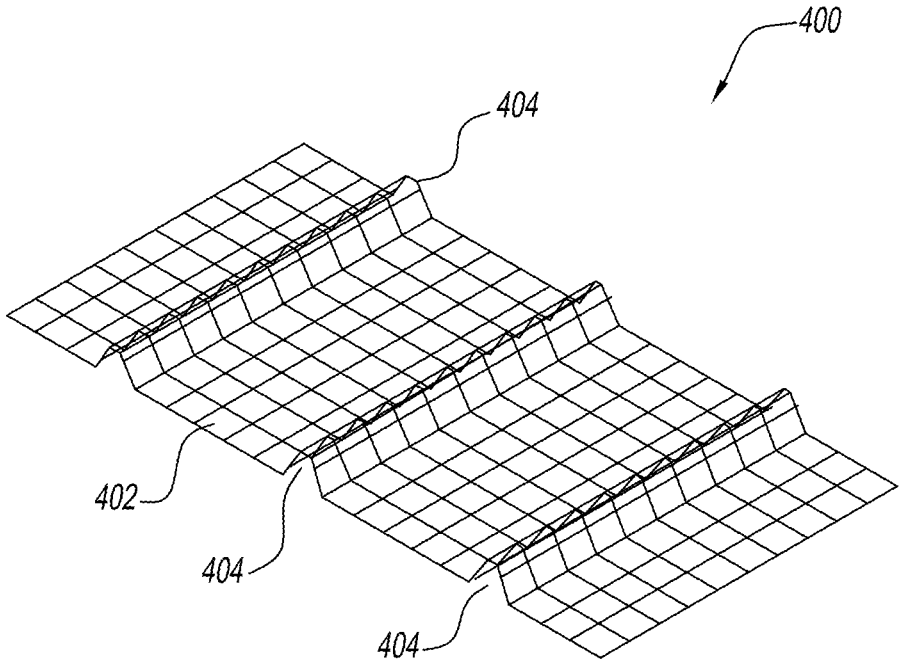
FIG. 4 shows an isometric view of a single sheet of flexible wire mesh having raised corrugations in accordance with an embodiment of this disclosure.

In another embodiment, an isometric view of a single sheet of flexible wire mesh 400 having raised corrugations 404 is shown in FIG. 4. In an embodiment, the sheet of flexible wire mesh 400 has smooth wire in both directions. The flexible wire mesh 402 has multiple raised corrugations 404 that act as template depth girders for application of concrete or cement material at a defined depth such that the underground reinforcement system is encapsulated with the concrete or cement material. The size of the raised corrugations varies depending on the project. The flexible wire mesh 402 having raised corrugations 404 defines a geometric supporting framework (e.g., arch).

Figure 5:
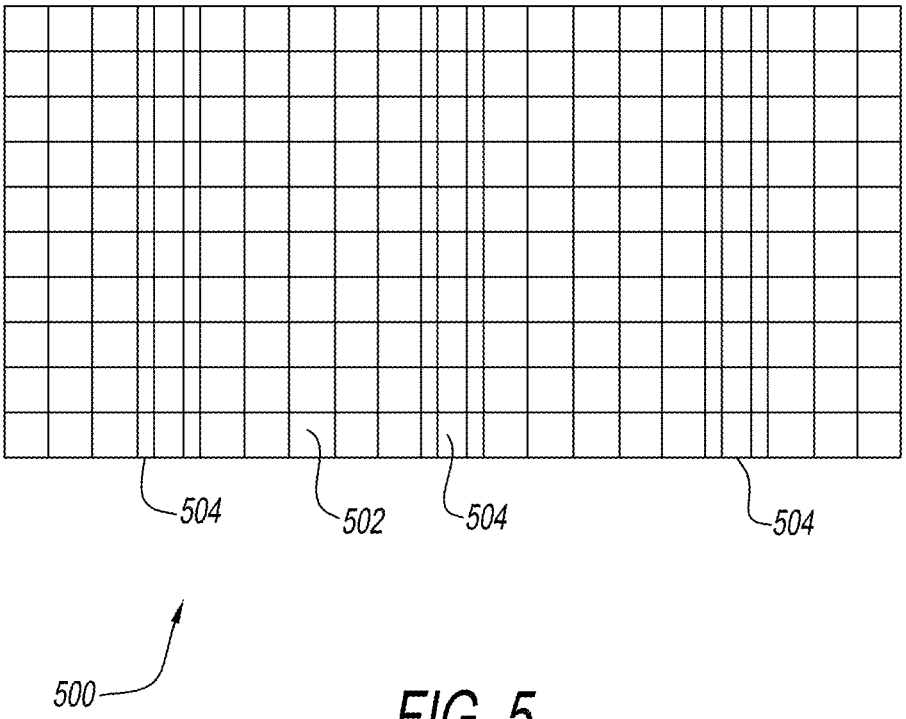
FIG. 5 shows a top view of the single sheet of flexible wire mesh in FIG. 4 in accordance with an embodiment of this disclosure.

FIG. 5 shows a top view of the single sheet of flexible wire mesh in FIG. 4 in accordance with an embodiment of this disclosure. In an embodiment, the sheet of flexible wire mesh 500 has smooth wire in both directions. The flexible wire mesh 502 has multiple raised corrugations 504. The size of the raised corrugations varies depending on the project.

Figure 6:
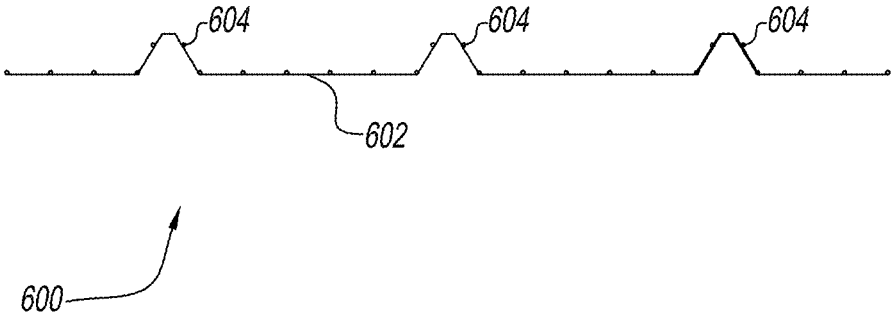
FIG. 6 shows a side view of the single sheet of flexible wire mesh in FIG. 4 in accordance with an embodiment of this disclosure.

A side view of the single sheet of flexible wire mesh in FIG. 4 in accordance with an embodiment of this disclosure is shown in FIG. 6. In an embodiment, the sheet of flexible wire mesh 600 has smooth wire in both directions. The flexible wire mesh 602 has multiple raised corrugations 604. The size and shape of the raised corrugations 604 varies depending on the project.

Figure 7:
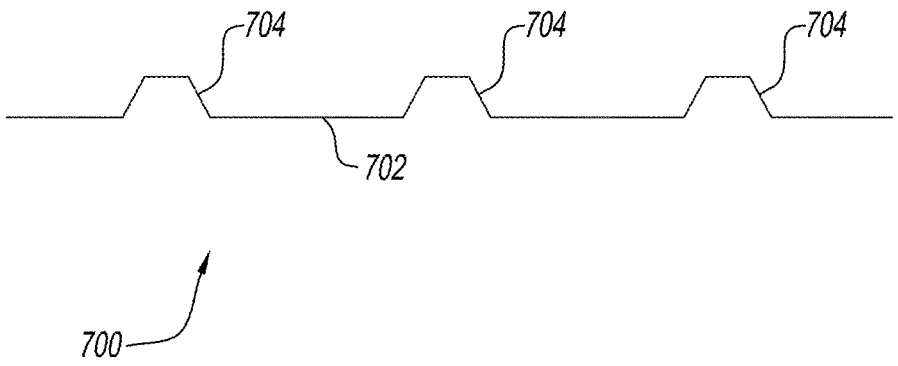
FIG. 7 shows an optional side view of a single sheet of flexible wire mesh in accordance with an embodiment of this disclosure.

A side view of the single sheet of flexible wire mesh in FIG. 4 in accordance with an embodiment of this disclosure is shown in FIG. 7. In an embodiment, the sheet of flexible wire mesh 700 has smooth wire in both directions. The flexible wire mesh 702 has multiple raised corrugations 704. The size and shape of the raised corrugations 704 varies depending on the project.

Figure 8:
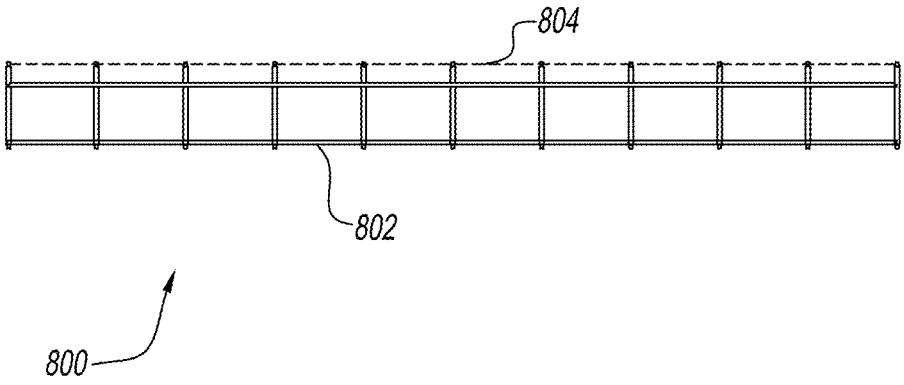
FIG. 8 shows an end view of the single sheet of flexible wire mesh in FIG. 4 in accordance with an embodiment of this disclosure.

An end view of the single sheet of flexible wire mesh in FIG. 4 in accordance with an embodiment of this disclosure is shown in FIG. 8. In an embodiment, the sheet of flexible wire mesh 800 has smooth wire in both directions. The flexible wire mesh 802 has multiple raised corrugations 804. The size and shape of the raised corrugations 804 varies depending on the project.

Figure 9:
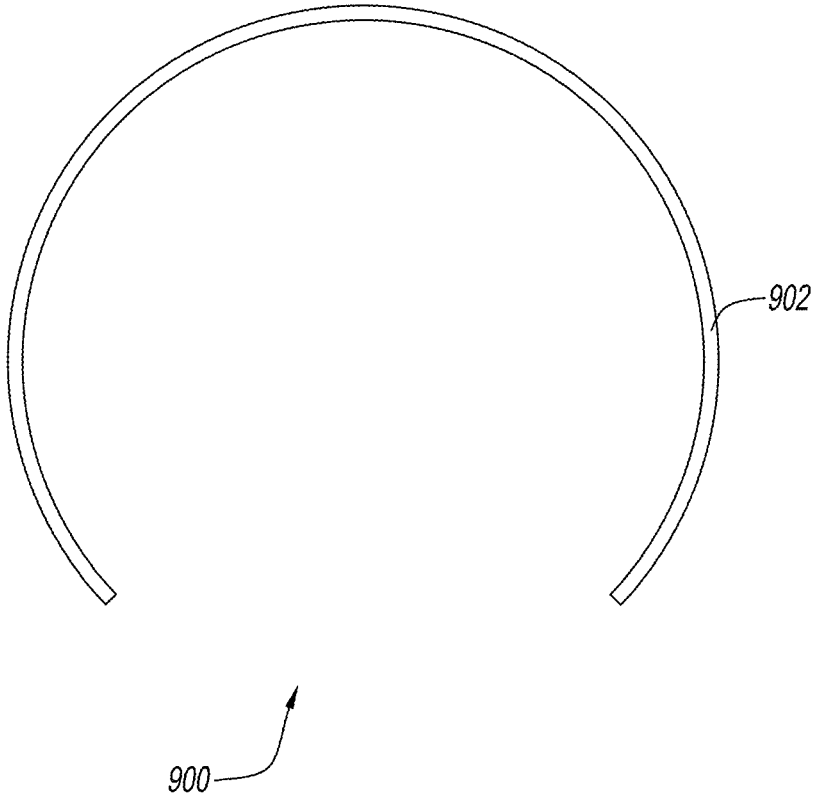
FIG. 9 shows a pressed profile transverse ribs of flexible wire mesh in accordance with an embodiment of this disclosure.

FIG. 9 shows a pressed profile transverse ribs 900 of flexible wire mesh 902 in accordance with an embodiment of this disclosure.

Figure 10:
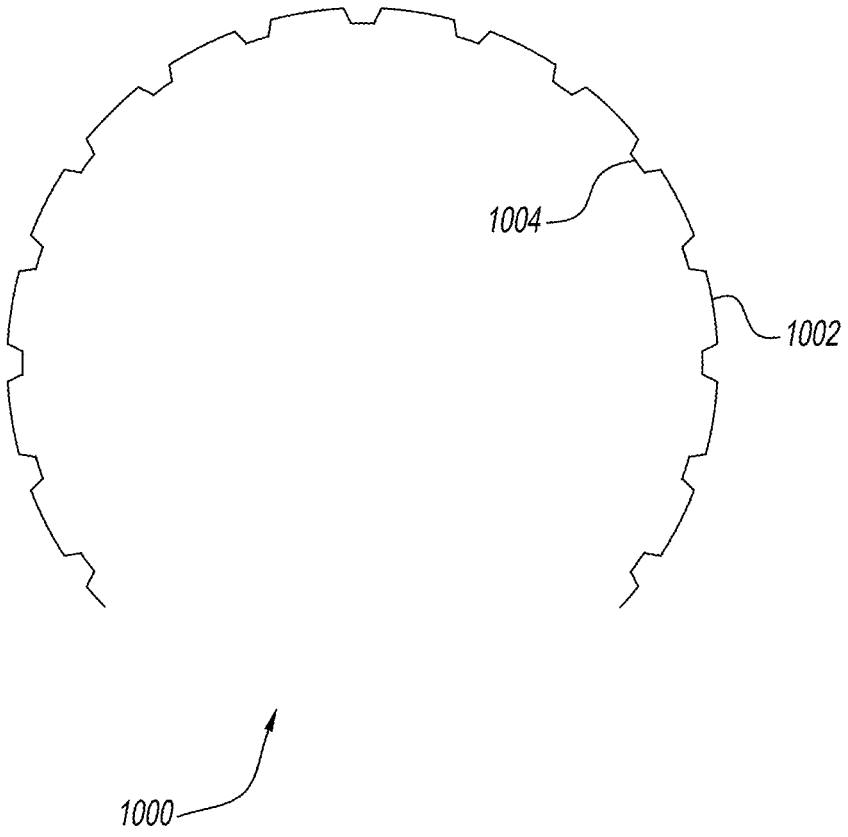
FIG. 10 shows a pressed profile longitudinal ribs of flexible wire mesh in accordance with an embodiment of this disclosure.

FIG. 10 shows a pressed profile longitudinal ribs 1000 of flexible wire mesh 1002 in accordance with an embodiment of this disclosure. The flexible wire mesh 1002 has multiple raised corrugations 1004. The size and shape of the raised corrugations 1004 varies depending on the project.

Figure 11:
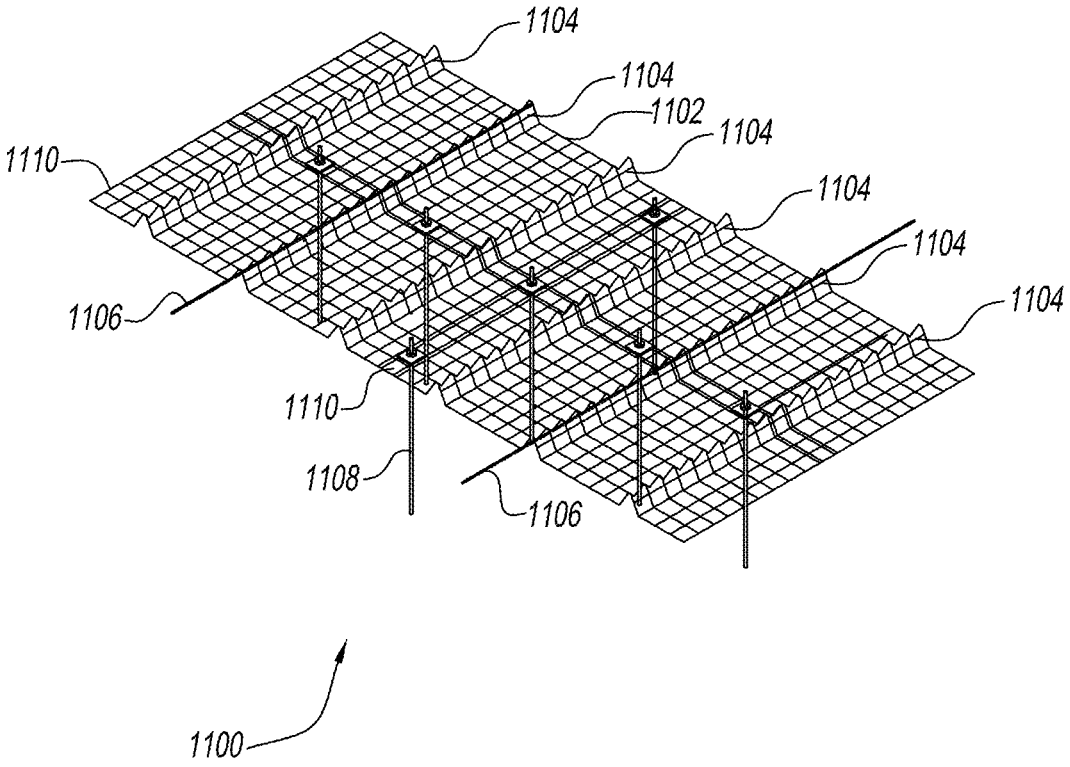
FIG. 11 shows an isometric view of adjacent overlapped sheets of flexible wire mesh in accordance with an embodiment of this disclosure.

An isometric view of adjacent overlapped sheets of flexible wire mesh 1100 having raised corrugations 1104 in accordance with an embodiment of this disclosure is shown in FIG. 11. In an embodiment, the overlapped sheets of flexible wire mesh 1100 have smooth wire in both directions. The flexible wire mesh 1102 has multiple raised corrugations 1104 that act as template depth girders for application of concrete or cement material at a defined depth such that the underground reinforcement system is encapsulated with the concrete or cement material. The size of the raised corrugations varies depending on the project. The overlapped sheets of flexible wire mesh 1100 have optional rebar for lap joints 1106. Rock bolts 1108 are shown for placement of the overlapped sheets of flexible wire mesh 1100 as required. Overlap location 1110 is shown connecting sheets of flexible wire mesh 1102. The flexible wire mesh 1102 having raised corrugations 1104 defines a geometric supporting framework (e.g., arch).

The flexible wire mesh sheets can be positioned along the length of an underground space. One or more stabilizing members can be connected to adjacent mesh sheets. Illustrative stabilizing members include, for example, tie rods and the like. In addition, one or more stabilizing members can be connected to structural supports for use in stabilizing the structural supports against the surface of the underground space, e.g., tunnel, shaft, cavern or station. Illustrative stabilizing members include, for example, rods, hooks, and the like.

Lattice girders used in the underground reinforcement system of this disclosure described, for example, in copending U.S. Patent Application Ser. No. 62/807,796, filed Feb. 20, 2019, the disclosure of which is incorporated herein by reference in its entirety.

The geometric shape of the tunnel reinforcement system of this disclosure can be adaptable to any substrate geometry. In particular, the tunnel reinforcement system of this disclosure can be a universal geometric shape (e.g., ellipsoid, trapezoid, square, rectangular, circle, and the like). The substrate can include, for example, rock, soil, or an existing structure.

In addition to substrate support, the wire mesh used in this disclosure and/or other intrados or extrados bars (longitudinal to the tunnel axis) afford concrete shrinkage or cracking control. The tunnel reinforcement system of this disclosure includes customized hooks to attach mesh to the tunnel support system. This also supports the original rebar design intent and function. In an embodiment, wire mesh is applied over some or all of the underground reinforcement system to facilitate adherence of the cementitious sealing composition.

In an embodiment, rebar can be used to interconnect with the flexible wire mesh. A combination of rebar and flexible wire mesh can also be used. The flexible wire mesh can be encapsulated with fiber reinforced shotcrete.

In an embodiment, whole sections of the underground reinforcement system can be pre-assembled above ground. After assembly, the whole sections can be lowered by crane into the underground space, e.g., tunnel, shaft, cavern or station, for installation.

Tie rods may be useful in the underground support system of this disclosure, especially when the final underground reinforcement system uses lattice girders. The number is tie rods used in the underground reinforcement system of this disclosure is not critical. The underground reinforcement system consists of nominal or higher strength steel with increased bar spacing if acceptable or a replication of the original design in a modular form for installation reducing on site labor costs, improving efficiency and providing a safer work space.

In an embodiment, underground reinforcement systems of this disclosure can have intersecting geometries. In particular, the intersection of two (2) ellipsoidal underground reinforcement systems is part of this disclosure.

For underground reinforcement systems having intersecting geometries, moment connections simplify the reinforcement bar mat. The moment connections are designed to transfer bending moments, shear forces and sometimes normal forces. The design strength and stiffness of a moment connection are defined in relation to the strength and stiffness of the connected underground reinforcement systems. The design strength of a moment connection may be full strength (i.e., the moment capacity of the connection is equal to or larger than the capacity of the connected underground reinforcement systems) or partial strength (i.e., the moment capacity of the connection is less than that of the connected underground reinforcement systems). Similarly, the stiffness of a moment connection can be rigid or semi-rigid compared to the stiffness of the connected underground reinforcement systems.

In an embodiment, tunnels, shafts and caverns are first created by earth or rock excavation with an immediate application of an initial support structure. The initial support structure is typically a template lattice girder mesh of some depth and spacing to allow the spray application of zero slump shotcrete which adheres to cavern walls and ceilings. The depth of concrete is of a designed depth and the lattice girder mesh functions as a concrete depth gage and provide a minimal structural element of support to the initial shell. The final support structure of lattice girders can be far more dense in terms of steel and design as part of the initial and/or final shell in comparison to a conventional rebar system. The final support structure of lattice girders can be placed adjacent/inside of the initial shell and is then encapsulated to the finished wall lines by either more shotcrete or concrete pumped into forms under high pressure. Final concrete panels of 50 feet are typical. The travelling formwork leap frogs back and forth until all the final tunnel reinforcement system and concrete is placed completing the final shell.

The tunnel reinforcement system of this disclosure is encapsulated to the finished wall lines by overlaying or encapsulating with concrete. Illustrative concrete includes, for example, shotcrete concrete, zero slump concrete, sliding form concrete, and the like. The concrete can be pumped into movable forms under pressure. The movable formwork leap frogs back and forth until all the final tunnel reinforcement system and concrete is placed, thereby completing the final shell.

In an embodiment, the underground reinforcement system is constructed out of a prefabricated sheets of metal wire mesh that overlap to form the walls and roof of the underground reinforcement system. The underground reinforcement system is configured to fit the applicable intersection, as irregularities of the tunnel leads to varying dimensions of intersections.

The underground reinforcement system of this disclosure can be prefabricated off site. This allows welding of mesh placement and overlapping or intersections instead of tied, and provides repetitive and improved quality and durability during placement on site. The underground reinforcement system of this disclosure provides compression for holding in place the underground tunnel roof and sidewall material, and thereby prevents collapse of the underground support members useful in this disclosure may be formed by conventional methods known in the art.

Alternatively, the underground reinforcement system (i.e. initial and final liner) can be assembled in place in the underground space. A cementitious sealing composition is applied to the exterior of the underground reinforcement system in order to provide sealing as well as strength. For example, shotcrete or gunite is applied to tunnel reinforcement system in order to not only seal the system, but also to span any gaps between the system and the sidewalls and ceiling defining the passageways in which the system is positioned. The wire mesh facilitates adherence of the cementitious sealing composition.

The embodiments of the tunnel reinforcement system of this disclosure can be sufficiently flexible to compensate for variations in the angle of the roof and side walls, and/or variations due to non-planar surfaces of the roof and/or side walls.

In an embodiment, the tunnel support system of this disclosure includes a moisture barrier system. The moisture barrier system is positioned between the initial tunnel reinforcement system that has been encapsulated with concrete or a cement material, and the final tunnel reinforcement system that has been encapsulated with concrete or a cement material. Illustrative moisture barriers include, for example, plastic materials (e.g., polyethylene plastic), sealants, foams, and the like.

The tunnel support system of this disclosure is useful in a variety of applications, for example, tunneling, excavating, mining, and the like. In an embodiment, the tunnel support system is useful for underground tunneling for transportation purposes (e.g., building underground railways or roadways). Other applications include, for example, sewerage tunnels, utility tunnels, and the like.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. An underground support system comprising:

an underground reinforcement system comprising:

a flexible wire mesh comprising a matrix of longitudinally and transversely extending metal wires;

wherein the flexible wire mesh is configured from a plurality of metal wires that are either welded or woven together;

wherein the matrix of longitudinally and transversely extending metal wires comprises a plurality of three-dimensional sheets connected in an overlapping configuration, each said sheet having at least one raised corrugation, positioned along the length of an underground space;

wherein the raised corrugation acts as a template depth girder for application of concrete or cement material at a defined depth such that the underground reinforcement system is at least partially encapsulated with the concrete or cement material;

wherein the spacing and height of the raised corrugation is a design element specific to the application for concrete or cement material depth and intended girder dimensions; and one or more stabilizing members connected to said flexible wire mesh, or one or more stabilizing members connected to overlapping sheets of said flexible wire mesh, wherein the stabilizing members connected to said flexible wire mesh comprise bolts or hooks, and the stabilizing members connected to overlapping sheets of flexible wire mesh comprise tie rods.

2. The underground support system of claim 1 wherein the flexible wire mesh permits positioning or bending of said sheets along the length and geometry of the underground space.

3. The underground support system of claim 1 wherein the flexible wire mesh comprises at least two said raised corrugations per sheet.

4. The underground support system of claim 1 wherein the underground reinforcement system further comprises at least one rebar interconnecting with the flexible wire mesh.

5. The underground support system of claim 1 comprising an intersection of at least two said underground reinforcement systems.

6. An underground support system comprising:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system and the second underground reinforcement system;

wherein the first underground reinforcement system comprises:

a flexible wire mesh comprising a matrix of longitudinally and transversely extending metal wires;

wherein the matrix of longitudinally and transversely extending metal wires of said first underground reinforcement system comprises at least one three-dimensional sheet, said sheet having at least one raised corrugation, positioned along the length of an underground space;

wherein the raised corrugation acts as a template depth girder for application of said concrete or cement material at a defined depth such that the first underground reinforcement system is at least partially encapsulated with the concrete or cement material; and wherein the second underground reinforcement system comprises: a plurality of structural supports positioned at spaced intervals along the length of an underground space; wherein the structural supports comprise lattice girders.

7. The underground support system of claim 6 wherein the moisture barrier system is at least one barrier selected from the group consisting of: a plastic material, sealant, and foam.

8. An underground support system comprising:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system, and the second underground reinforcement system;

wherein at least one of the first underground reinforcement system and the second underground reinforcement system comprises:

a flexible wire mesh comprising a matrix of longitudinally and transversely extending metal wires;

wherein the matrix of longitudinally and transversely extending metal wires comprises at least one three-dimensional sheet, each sheet having at least one raised corrugation, positioned along the length of an underground space; and wherein the raised corrugation acts as a template depth girder for application of said concrete or cement material at a defined depth.

9. An underground support system comprising:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system, and the second underground reinforcement system;

wherein the first underground reinforcement system and the second underground reinforcement system comprise:

a flexible wire mesh comprising a matrix of longitudinally and transversely extending metal wires;

wherein the matrix of longitudinally and transversely extending metal wires comprises at least one three-dimensional sheet, said sheet having at least one raised corrugation, positioned along the length of an underground space; and wherein the raised corrugation acts as a template depth girder for application of concrete or cement material at a defined depth such that the underground reinforcement system is at least partially encapsulated with the concrete or cement material.

10. A method of supporting an underground space, said method comprising:

positioning an underground support system against an underground substrate; and maintaining the underground support system in contact with the underground substrate;

wherein the underground support system comprises:

an underground reinforcement system comprising:

a flexible wire mesh comprising a matrix of longitudinally and transversely extending metal wires;

wherein the flexible wire mesh is configured from a plurality of metal wires that are either welded or woven together;

wherein the matrix of longitudinally and transversely extending metal wires comprises a plurality of three-dimensional sheets connected in an overlapping configuration, each said sheet having at least one raised corrugation, positioned along the length of an underground space;

wherein the raised corrugation acts as a template depth girder for application of concrete or cement material at a defined depth such that the underground reinforcement system is at least partially encapsulated with the concrete or cement material;

wherein the spacing and height of the raised corrugation is a design element specific to the application for concrete or cement material depth and intended girder dimensions; and one or more stabilizing members connected to said flexible wire mesh, or one or more stabilizing members connected to overlapping sheets of said flexible wire mesh, wherein the stabilizing members connected to said flexible wire mesh comprise bolts or hooks, and the stabilizing members connected to overlapping sheets of flexible wire mesh comprise tie rods.

11. The method of claim 10 wherein the underground support system is installed in an underground excavation that is vertically or horizontally oriented.

12. The method of claim 10 wherein the underground reinforcement system is prefabricated and installed on site.

13. The method of claim 10 wherein the underground support system comprises an intersection of two or more underground reinforcement systems.

14. A method of supporting an underground space, said method comprising:

positioning an underground support system against an underground substrate; and maintaining the underground support system in contact with the underground substrate;

wherein the underground support system comprises:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system, and the second underground reinforcement system;

wherein the first underground reinforcement system comprises:

a flexible wire mesh comprising a matrix of longitudinally and transversely extending metal wires;

wherein the matrix of longitudinally and transversely extending metal wires comprises at least one three-dimensional sheet, said sheet having at least one raised corrugation, positioned along the length of an underground space;

wherein the raised corrugation acts as a template depth girder for application of concrete or cement material at a defined depth such that the underground reinforcement system is at least partially encapsulated with the concrete or cement material;

wherein the second underground reinforcement system comprises:

a plurality of structural supports positioned at spaced intervals along the length of the underground; wherein the structural supports comprise lattice girders.

15. The method of claim 14 wherein the substrate comprises rock, soil, or an existing structure.

16. The method of claim 14 wherein the moisture barrier system is at least one barrier selected from the group consisting of: a plastic material, sealant, and foam.

17. The method of claim 14 wherein the flexible wire mesh comprises a plurality of sheets connected in an overlapping configuration.

18. The method of claim 14 wherein the flexible wire mesh permits positioning or bending of said sheets along the length and geometry of the underground.

19. The method of claim 14 wherein the flexible wire mesh has two or more raised corrugations per said three-dimensional sheet.

20. The method of claim 14 wherein the underground support system is installed in an underground excavation that is vertically or horizontally oriented.

21. The method of claim 14 wherein at least one of the first underground reinforcement system and the second underground reinforcement system is prefabricated and installed on site.

22. The method of claim 14 wherein the underground support system comprises an intersection of two or more underground reinforcement systems.

23. A method of supporting an underground space, said method comprising:

positioning an underground support system against an underground substrate; and maintaining the underground support system in contact with the underground substrate;

wherein the underground support system comprises:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system, and the second underground reinforcement system;

wherein the first underground reinforcement system and/or the second underground reinforcement system comprise:

a flexible wire mesh comprising a matrix of longitudinally and transversely extending metal wires;

wherein the matrix of longitudinally and transversely extending metal wires comprises at least one three-dimensional sheet, said sheet having at least one raised corrugation, positioned along the length of an underground space; and wherein the raised corrugation acts as a template depth girder for application of concrete or cement material at a defined depth such that the underground reinforcement system is at least partially encapsulated with the concrete or cement material.

24. A method of supporting an underground space said method comprising:

positioning an underground support system against an underground substrate; and maintaining the underground support system in contact with the underground substrate;

wherein the underground support system comprises:

a first underground reinforcement system; wherein the first underground reinforcement system is at least partially encapsulated with concrete or a cement material;

a second underground reinforcement system; wherein the second underground reinforcement system is at least partially encapsulated with concrete or a cement material; and a moisture barrier system; wherein the moisture barrier system is positioned between the first underground reinforcement system, and the second underground reinforcement system;

wherein the first underground reinforcement system and the second underground reinforcement system comprise:

a flexible wire mesh comprising a matrix of longitudinally and transversely extending metal wires;

wherein the matrix of longitudinally and transversely extending metal wires comprises at least one three-dimensional sheet, said sheet having at least one raised corrugation, positioned along the length of an underground space; and wherein the raised corrugation acts as a template depth girder for application of concrete or cement material at a defined depth such that the underground reinforcement system is at least partially encapsulated with the concrete or cement material.

25. An underground reinforcement system comprising:

a flexible wire mesh comprising a matrix of longitudinally and transversely extending metal wires;

wherein the flexible wire mesh is configured from a plurality of metal wires that are either welded or woven together;

wherein the matrix of longitudinally and transversely extending metal wires comprises a plurality of three-dimensional sheets connected in an overlapping configuration, each sheet having at least one raised corrugation, positioned along the length of an underground space;

wherein the raised corrugation acts as a template depth girder for application of concrete or cement material at a defined depth such that the underground reinforcement system is at least partially encapsulated with the concrete or cement material;

wherein the spacing and height of the raised corrugation is a design element specific to the application for concrete or cement material depth and intended girder dimensions; and one or more stabilizing members connected to said flexible wire mesh, or one or more stabilizing members connected to overlapping sheets of said flexible wire mesh, wherein the stabilizing members connected to said flexible wire mesh comprise bolts or hooks, and the stabilizing members connected to overlapping sheets of flexible wire mesh comprise tie rods.

26. The underground reinforcement system of claim 25 wherein the flexible wire mesh has two or more raised corrugations per sheet.

27. The underground reinforcement system of claim 25 installed in an underground excavation that is vertically or horizontally oriented.

28. The underground reinforcement system of claim 25 which is prefabricated and installed on site.

29. The underground reinforcement system of claim 25 comprising an intersection of two or more underground reinforcement systems.

* * * * *